US008612219B2

(12) United States Patent
Tsuchinaga et al.

(10) Patent No.: US 8,612,219 B2
(45) Date of Patent: Dec. 17, 2013

(54) SBR ENCODER WITH HIGH FREQUENCY PARAMETER BIT ESTIMATING AND LIMITING

(75) Inventors: Yoshiteru Tsuchinaga, Fukuoka (JP); Masanao Suzuki, Kawasaki (JP); Miyuki Shirakawa, Fukuoka (JP); Takashi Makiuchi, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 1392 days.

(21) Appl. No.: 11/907,341

(22) Filed: Oct. 11, 2007

(65) Prior Publication Data

US 2008/0097751 A1 Apr. 24, 2008

(30) Foreign Application Priority Data

Oct. 23, 2006 (JP) ..... 2006-287921

(51) Int. Cl.
*G10L 19/02* (2013.01)
*G10L 21/00* (2013.01)

(52) U.S. Cl.
USPC ..... 704/229; 704/201; 704/200.1

(58) Field of Classification Search
USPC ..... 704/200–230
See application file for complete search history.

(56) References Cited

U.S. PATENT DOCUMENTS 5,301,205 A * 4/1994 Tsutsui et al. ..... 375/340
5,687,157 A 11/1997 Imai et al.
5,911,128 A * 6/1999 DeJaco ..... 704/200.1
6,226,616 B1 * 5/2001 You et al. ..... 704/500
7,072,366 B2 * 7/2006 Parkkinen et al. ..... 370/538
7,469,206 B2 * 12/2008 Kjorling et al. ..... 704/205
7,720,676 B2 * 5/2010 Philippe et al. ..... 704/201
2005/0273322 A1 * 12/2005 Lee et al. ..... 704/212
2006/0031065 A1 2/2006 Liljeryd et al.
2006/0235678 A1 10/2006 Kim et al.

FOREIGN PATENT DOCUMENTS

EP 0 554 081 8/1993
JP 05-183523 7/1993
JP 07-283758 10/1995
JP 08-030295 2/1996

(Continued)

OTHER PUBLICATIONS

Dietz M, et al., "Spectral Band Replication, A Novel Approach in Audio Coding", Audio Engineering Society Convention Paper, New York, NY, US, vol. 112, No. 5553; May 10, 2002, pp. 1-8, XP009020921; *p. 3, right-hand column, paragraph 3—p. 5, left-hand column, paragraph 1* figure 8*.

(Continued)

*Primary Examiner* — Jesse Pullias
(74) *Attorney, Agent, or Firm* — Fujitsu Patent Center

(57) ABSTRACT

An SBR encoder includes a filter bank that receives an input signal, a time/frequency grid generator that controls a number of bits of various parameters, a parameter calculator that calculates various parameters, a parameter coding unit that encodes the parameters, an upper-limit number-of-bit storage unit that stores an upper limit of the number of bit of encoded data of high-frequency component finally generated in a high-pass encoding process, and a number-of-bit controller. The number-of-bit controller controls the high-pass encoding process by preferentially encoding a parameter having a large influence to sound quality and not encoding a parameter having a small influence to the sound quality relative to a plurality of parameters, so that the number of bits of the encoded data of high-frequency component finally generated in the high-pass encoding process becomes equal to or less than the upper limit to be stored in the upper-limit number-of-bit storage unit.

18 Claims, 11 Drawing Sheets

(56) References Cited

FOREIGN PATENT DOCUMENTS

| | | | |
|---|---|---|---|
| JP | 10-240297 | | 9/1998 |
| JP | 11-242499 | | 9/1999 |
| JP | 11-249696 | | 9/1999 |
| JP | 2001-267928 | A | 9/2001 |
| JP | 2005-010801 | A | 1/2005 |
| JP | 2005-121743 | A | 5/2005 |
| JP | 2005-345707 | A | 12/2005 |
| JP | 2006-106475 | | 4/2006 |
| JP | 2006-154629 | A | 6/2006 |
| WO | WO 02/41302 | | 5/2002 |

OTHER PUBLICATIONS

Liu CM, et al., "Bit Reservoir Design for He-AAC" Audio Engineering Society Convention Paper, New York, NY, US; May 28, 2005, pp. 1-9, XP009095800* abstract* figure 1* p. 2, left-hand column, paragraph 3* figure 4*.

"Japanese Office Action" mailed by JPO and corresponding to Japanese application No. 2006-287921 on May 31, 2011, with English translation.

* cited by examiner

SBR ENCODER WITH HIGH FREQUENCY PARAMETER BIT ESTIMATING AND LIMITING

BACKGROUND OF THE INVENTION

1. Field of the Invention

The present invention relates to an encoder that performs a high-pass encoding process in which an input signal is divided into frames formed of certain samples and calculates a plurality of parameters indicating characteristics of a high-frequency component in the input signal, thereby generating encoded data of high-frequency component.

2. Description of the Related Art

Conventionally, music files and video images having a large volume are transferred via a network such as the Internet due to popularization of mobile phones, personal computers, and the like.

An encoding technique for reducing the volume by compressing the music files and the like having a large volume has been used for quickly transmitting the music files and the like having the large volume, on a line with a slow transmission speed (a low bit rate). The encoding technique is also used when the music file and the like are accumulated and recorded on a digital versatile disk (DVD). In such encoding technique, various techniques for encoding the original music file into a smaller volume without degrading the sound quality of the original music file are disclosed.

Generally, as shown in FIG. 9, an encoder combining a spectral band replication (SBR) encoding method and a core encoding method is used for such encoding. Specifically, as shown in FIG. 10, a low-frequency component in an input signal obtained by down-sampling the input signal is encoded by the core encoding method, and a plurality of characteristic parameter information (for example, spectral power information, noise information, frequency position information of tone components, and the like) required for generating a high-frequency component in the input signal is encoded by the SBR encoding method, using the encoded information of the low-frequency component.

By the SBR encoding method, for example, the file volume after encoding can be greatly reduced than the original volume of the music file, and in the encoded file, not only being able to play the music file from the head but also it is able to play the music file from halfway (Japanese Patent Application Laid-open No. 2006-106475).

The core encoding method and the SBR encoding method are explained. For the core encoding method, a transform coding method, which performs coding in a region where an input signal is transformed into a frequency domain, is generally used, and a quantization error and the number of encoding bits in coding can be arbitrarily controlled. Here, the quantization error and the number of encoding bits are in a trade-off relation. That is, if a number of encoding bits is small, the quantization error increases so that the sound quality is degraded, and if the number of encoding bits is large, the quantization error decreases so that the sound quality is improved.

According to the SBR encoding method, the plurality of the characteristic parameter information for generating the high-frequency component in the input signal are obtained based on an input spectrum obtained by inputting the input signal to a filter bank, which are then encoded. In the SBR encoding method, as shown in FIG. 11, each parameter is obtained for each segment section (hereinafter, referred to as "time/frequency grid") in which the input spectrum signal (with a fixed length) for one frame is divided in a time direction and a frequency direction.

In the SBR encoding method, the time/frequency grid width is adaptively changed according to the input signal, to improve encoding performance. For example, in a variable part where a change of the input signal is large (where a spectral change in the time direction is large), time resolution is increased (the time grid width is small (the number of divisions increases), and the frequency grid width is large (the number, of divisions decreases)). On the contrary, in a stationary part where the change of the input signal is small (where a spectral change in the time direction is small), frequency resolution is increased (the time grid width is large (the number of divisions decreases), and the frequency grid width is small (the number of divisions increases)).

As the grid width becomes smaller (as the number of divisions increases), the number of parameters obtained for each frame increases; therefore, the amount of information increases. As a result, the number of encoding bits increases. Further, the number of encoding bits of each parameter obtained for each grid changes according to the property of the input signal. That is, in the SBR encoding method, the number of encoding bits fluctuates according to the property of the input signal.

Therefore, in an encoder combining the SBR encoding method and the core encoding method, when it is assumed that an available number of encoding bits per one frame is "X," the number of bits used in the core encoding method is "Y." and the number of bits used in the SBR encoding method is "Z," the number of bits is controlled so that a sum of "Y" and "Z" does not exceed "X." That is, the sum of "Y" and "Z" satisfies the encoding condition, $Y+Z \leq X$.

Specifically, the encoder first determines the number of bits "Z" used in the SBR encoding method so that the number of bits obtained by subtracting "Z" from the total number of bits "X" becomes "Y." and the encoder controls the number of bits used in the core encoding method to be equal to or less than "Y." That is, the encoder performs core encoding with the number of bits "Y." which is a remaining number of bits after subtracting the bits "Z" for the SBR encoding from the available number of bits "X," and controls the entire number of bits "X" by controlling the number of bits "Y."

In the conventional technique described above, since the total number of encoding bits "X" is fixed, the number of core encoding bits "Y" indicating the number of bits of encoded data of low-frequency component is automatically determined when the number of SBR encoding bits "Z" indicating the number of bits of encoded data of high-frequency component is set. Accordingly, there is a problem in that if the value of "Z" increases locally, the value of "Y" considerably decreases.

To explain the above-described problem more in detail, in a one-segment broadcasting system or the like, the number of SBR encoding bits varies according to the property of the input signal when a stereo signal of 48-kHz sampling is encoded under an ultra low bit rate (high compression) condition of equal to or less than 40 kilobits per second (kbps), that is, under a condition in which the available number of bits is small for each frame. Therefore, the number of SBR encoding bits cannot be controlled to an arbitrary number of bits for each frame. While an average bit rate of SBR encoded bits is generally about 3 to 5 kbps, the bit rate can locally be 20 kbps or higher according to the property of the input signal.

Here, the number of encoding bits allocated to the core encoding becomes considerably small, namely, as small as 20 kbps or less. Therefore, the quantization error in the core encoding increases due to insufficient bits. That is, as shown in FIG. 13, a distortion of the low-frequency spectrum component increases relative to the input signal. Further, because the high-frequency spectrum component is generated by the SBR encoding based on the low-frequency spectrum component with a large distortion, the low-frequency distortion propagates to the high-frequency side. As a result, the spectral distortion of the whole frequency component increases, thereby causing large degradation of sound quality.

SUMMARY OF THE INVENTION

It is an object of the present invention to at least partially solve the problems in the conventional technology.

According to one aspect of the present invention, an encoder that performs a high-pass encoding process for dividing an input signal into frames formed of certain samples and calculating a plurality of parameters indicating characteristics of a high-frequency component in the input signal to generate encoded data of high-frequency component, includes an upper-limit number-of-bit storage unit that stores an upper limit of a number of bits of the encoded data of high-frequency component finally generated in the high-pass encoding process; and a number-of-bit controller that controls the high-pass encoding process so that the number of bits of the encoded data of high-frequency component finally generated in the high-pass encoding process becomes equal to or less than the upper limit stored in the upper-limit number-of-bit storage unit.

According to another aspect of the present invention, an encoding method that performs a high-pass encoding process for dividing an input signal into frames formed of certain samples and calculating a plurality of parameters indicating characteristics of a high-frequency component in the input signal to generate the encoded data of high-frequency component, includes storing an upper limit of a number of bits of the encoded data of high-frequency component finally generated in the high-pass encoding process; and controlling the high-pass encoding process so that the number of bits of the encoded data of high-frequency component finally generated in the high-pass encoding process becomes equal to or less than the upper limit stored in the upper-limit number-of-bit storage unit.

According to still another aspect of the present invention, a computer-readable recording medium that stores therein a computer program that implements the above method on a computer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
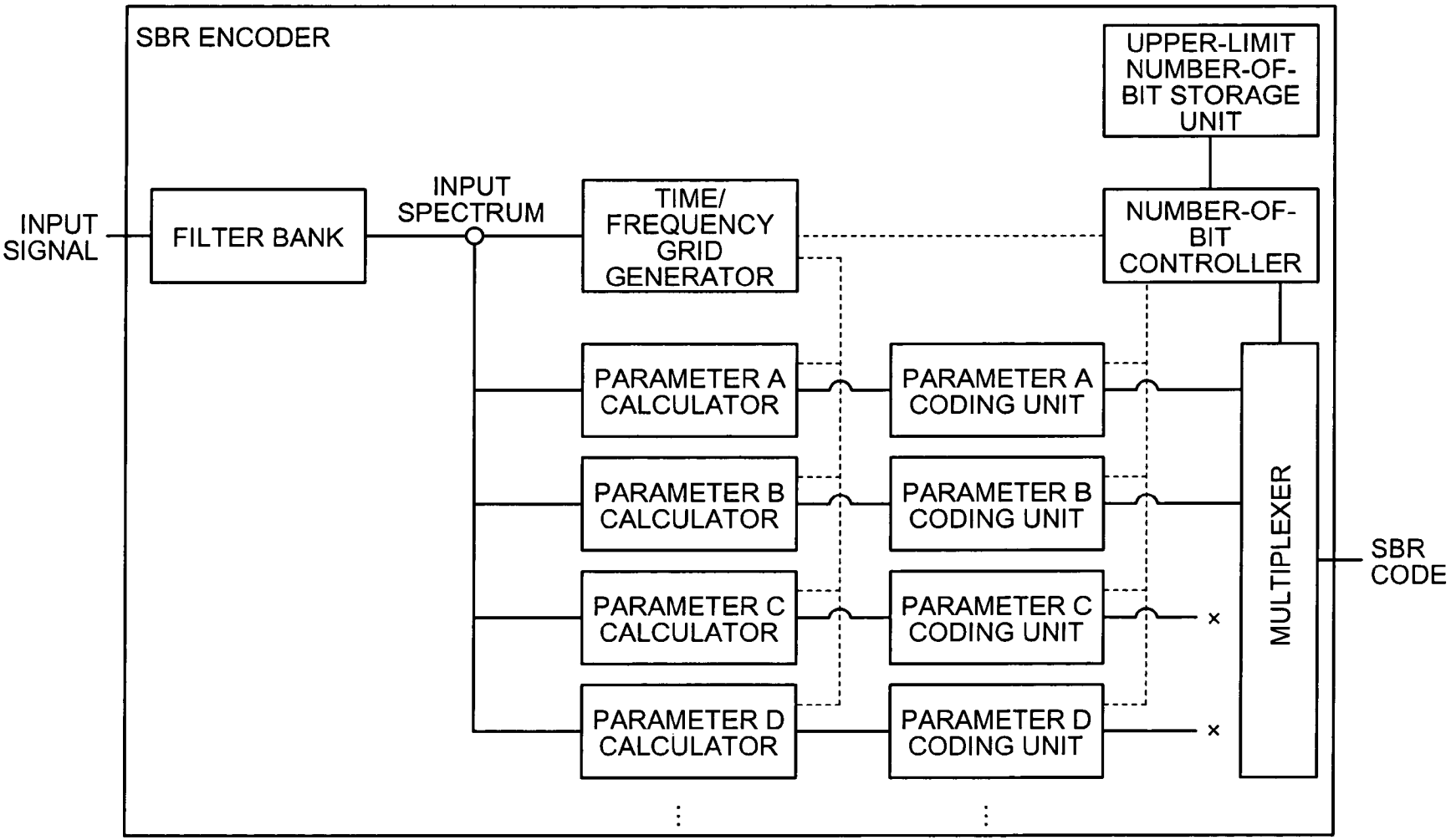
FIG. 1 is a schematic diagram for explaining an outline and characteristics of an SBR encoder according to a first embodiment of the present invention.

Exemplary embodiments of an encoder according to the present invention will be explained below in detail with reference to the accompanying drawings. Main terms used in the embodiments, an outline and characteristics of an encoder according to a first embodiment of the present invention, a configuration and process procedures of the encoder according to the first embodiment, and effects of the first embodiment are explained in this order, followed by explanations of other embodiments.

Main terms used in the first embodiment are explained first. An "SBR encoder" used in the first embodiment is an audio encoder to which a spectral band replication is applied. The SBR encoder performs a high-pass encoding process in which an input signal is divided into frames formed of certain samples, and a plurality of parameters indicating characteristics of a high-frequency component in the input signal is calculated, thereby generating encoded data of high-frequency component.

Specifically, the SBR encoder divides the input signal into frames in a time direction and a frequency direction, calculates parameters such as spectral power information, noise information, and frequency position information of tone components as a plurality of parameters indicating the characteristics of the high-frequency component in the input signal, and encodes the parameters to generate an SBR code stream "sbr_code" as the encoded data of high-frequency component. A series of processes from the reception of the input signal to the generation of the SBR code stream "sbr_code" is referred to as a "high-pass encoding process."

As audio coding standards for the use of the SBR encoder, MPEG-2 HE-AAC (Moving Picture Experts Group, High-Efficiency Advanced Audio Coding), MPEG-4 HE-AAC, Enhanced aacPlus, MP3PRO, or the like can be mentioned.

A "core encoder" is a technique for performing encoding in a region where the input signal is transformed into a frequency domain, and performs a low-pass encoding process for generating encoded data of low-frequency component from a low-frequency component in the input signal. Specifically, the core encoder divides the low frequency side of the input signal by a certain interval, and encodes the frequency band signal for each divided interval. For example, the core encoder obtains a low-frequency component of input signal by down-sampling the input signal to generate AAC code "AAC_code" as the encoded data of low-frequency component obtained by encoding the low-frequency component in the input signal. A series of processes to the generation of the AAC code "AAC_code" by down-sampling the input signal is referred to as a "low-pass encoding process".

Transfer of an encoded file in which a music file (music data) or the like is encoded is explained. Generally, a transmitter (an encoder) is configured by combining the core encoder and the SBR encoder. Specifically, the encoded data of low-frequency component is generated from the low-frequency component in the input signal by the core encoder, and a plurality of parameters indicating the characteristics of the high-frequency component in the input signal is calculated by the SBR encoder to generate the encoded data of high-frequency component. The encoder transmits the generated encoded data to a receiver (a decoder).

In the decoder having received the encoded data, data of low-frequency component is decoded from the received encoded data of low-frequency component, and data of high-frequency component is decoded from the decoded data of low frequency component by using the parameters obtained by decoding the encoded data of high-frequency component. Thus, the transmitter (the encoder) transmits encoded data obtained by encoding the audio file into small volume data, and the receiver (the decoder) decodes the whole frequency component data from the received encoded data, thereby obtaining the audio file to be transmitted.

An outline and characteristics of the SBR encoder according to the first embodiment are explained below with reference to FIG. 1. FIG. 1 is a schematic diagram for explaining the outline and the characteristics of the SBR encoder according to the first embodiment.

As shown in FIG. 1, the SBR encoder includes a filter bank that receives the input signal, a time/frequency grid generator that controls the number of bits of various parameters, parameter calculators (parameter A calculator to parameter D calculator) that calculate the various parameters, parameter coding units (parameter A coding unit to parameter D coding unit) that encode the parameters, and a multiplexer that multiplexes the encoded data. Parameters A to D have different influences to the sound quality in an order such that parameter A has the largest influence and parameter D has the smallest influence. The number of bits required for encoding parameters A to D are, respectively, 50 bits. That is, it is assumed that as the "influence to the sound quality, parameter name, and required number of bits," "1. parameter A, 50," "2. parameter B, 50," "3. parameter C, 50," and "4. parameter D, 50."

The SBR encoder performs the high-pass encoding process in which the input signal is divided into the frames formed of the certain samples and a plurality of parameters indicating the characteristics of the high-frequency component in the input signal is calculated, thereby generating the encoded data of high-frequency component. Specifically, there is a main characteristic such that the SBR encoder can avoid a local increase of the number of bits of the encoded data of high-frequency component.

The main characteristic is specifically explained. The SBR encoder includes an upper-limit number-of-bit storage unit that stores an upper limit of the number of bits of the encoded data of high-frequency component finally generated in the high-pass encoding process. Specifically, for example, the upper-limit number-of-bit storage unit stores, "'100' as the upper limit." The upper-limit number-of-bit storage unit can store the upper limit of the number of bits by estimating the upper limit from the number of bits obtained by performing the high-pass encoding process halfway relative to an encoding target, or by estimating the upper limit from the number of bits obtained by completely performing the high-pass encoding process relative to the encoding target, or can store the upper limit beforehand by receiving it from an external device.

A number-of-bit controller in the SBR encoder controls the high-pass encoding process by preferentially encoding the parameter having a large influence to the sound quality and not encoding the parameter having a small influence to the sound quality relative to a plurality of parameters, so that the number of bits of the encoded data of high-frequency component finally generated in the high-pass encoding process becomes equal to or less than the upper limit to be stored in the upper-limit number-of-bit storage unit.

Specifically, in the example mentioned above, the number-of-bit controller in the SBR encoder first encodes parameter A having the largest influence to the sound quality. The parameter A coding unit then encodes parameter A and transmits encoded data A (50 bits) to the multiplexer. Subsequently, the multiplexer calculates the number of bits from the received encoded data A and transmits the total number of bits (50 bits) used previously to the number-of-bit controller.

The number-of-bit controller then encodes parameter B having the next large influence to the sound quality. The parameter B coding unit encodes parameter B and transmits the encoded data B (50 bits) to the multiplexer. The multiplexer calculates the number of bits from the received encoded data B and transmits the total number of bits (100 bits) used previously to the number-of-bit controller.

Because the used number of bits reaches the upper limit, the SBR encoder multiplexes the encoded data A and B without encoding the remaining parameters (parameters C and D), and transmits the multiplexed data to the external device.

When there is a fraction in the available number of bits, the SBR encoder can encode the next parameter up to the upper limit, or can discard the fraction so that the next parameter is not encoded. Specifically, for example, when it is assumed that "1. parameter A, 50," "2. parameter B, 30," "3. parameter C, 40," and "4. parameter D. 50" as the "influence to the sound quality, parameter name, and number of bits," the SBR encoder encodes parameter A "50 bits" having the largest influence to the sound quality, and transmits the generated encoded data A to the multiplexer. Then, the SBR encoder calculates the remaining number of bits, "50 bits," by subtracting the used number of bits, "50 bits," from the upper limit "100 bits."

Subsequently, because the number of bits required for encoding parameter B having the next largest influence to the sound quality is "30 bits," and "50 bits" still remains up to the upper limit, the SBR encoder encodes parameter B having the next largest influence to the sound quality, and transmits the generated encoded data B to the multiplexer. Then, the SBR encoder calculates the remaining number of bits, "20 bits," by subtracting the used total number of bits, "80 bits," from the upper limit "100 bits."

Because the number of bits required for encoding parameter C having the next largest influence to the sound quality is "40 bits" and only "20 bits" remains up to the upper limit, the SBR encoder can encode parameter C to fit in "20 bits" or can finish the process without encoding parameter C.

In this manner, according to the SBR encoder in the first embodiment, when it is assumed that the order of parameters affecting the sound quality the most is parameter A, parameter B, parameter C, and parameter D, the parameters are encoded in an order started from parameter A. Thereafter, when the upper limit of the number of bits is reached, the parameters are discarded. As a result, a local increase in the number of bits of the encoded data of high-frequency component can be avoided.

Figure 2:
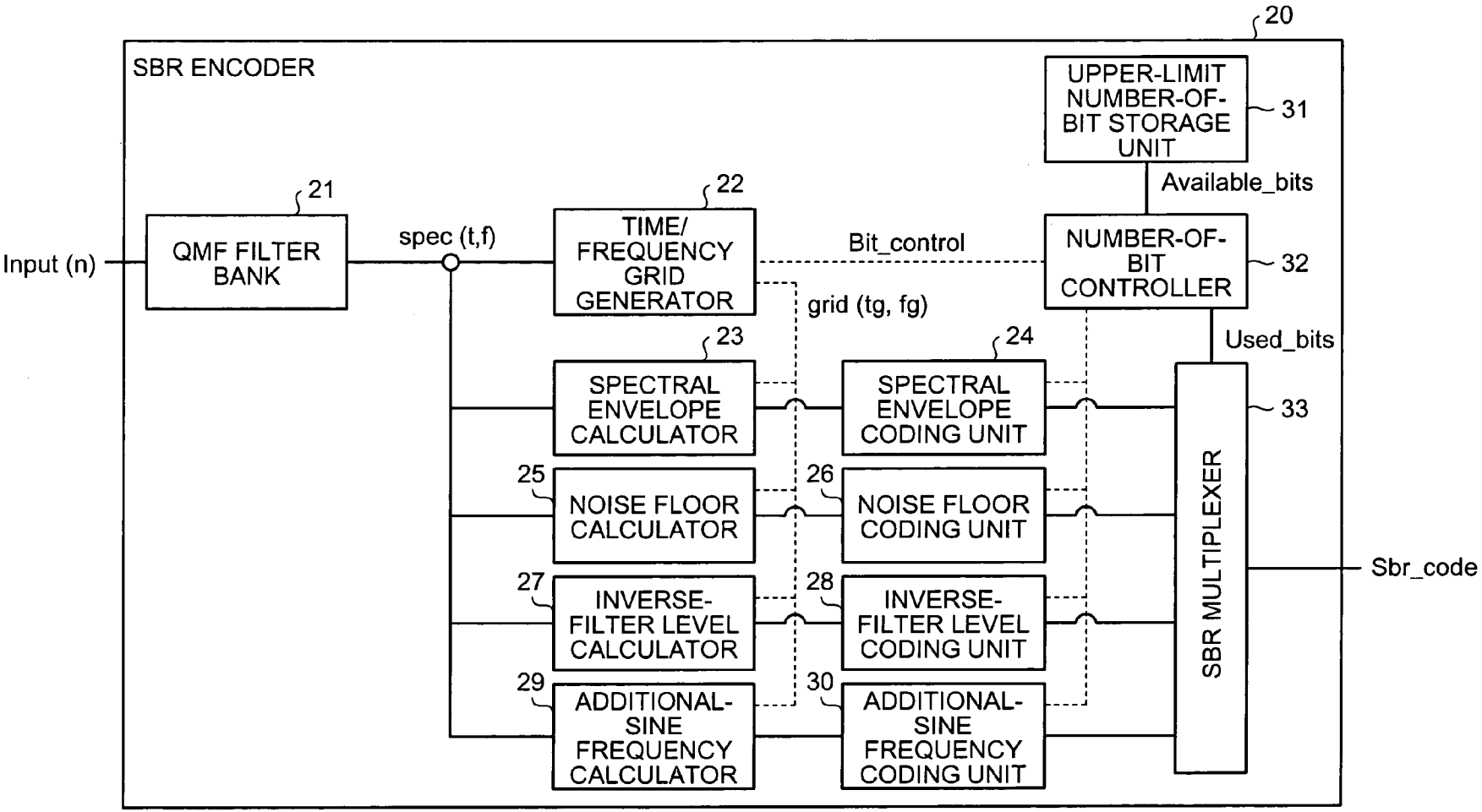
FIG. 2 is a block diagram of a configuration of the SBR encoder according to the first embodiment.

A configuration of the SBR encoder shown in FIG. 1 is explained next with reference to FIG. 2. FIG. 2 is a block diagram of the configuration of the SBR encoder according to the first embodiment. As shown in FIG. 2, an SBR encoder 20 includes a quadrature mirror filter (QMF) filter bank 21, a time/frequency grid generator 22, a spectral envelope calculator 23, a spectral envelope coding unit 24, a noise floor calculator 25, a noise floor coding unit 26, an inverse-filter level calculator 27, an inverse-filter level coding unit 28, an additional-sine frequency calculator 29, an additional-sine frequency coding unit 30, an upper-limit number-of-bit storage unit 31, a number-of-bit controller 32, and an SBR multiplexer 33.

The QMF filter bank 21 receives an input signal, and outputs a spectral signal. Specifically, for example, when an input signal of 2048 samples, "input (n) (n=0, 1, . . . 2047)," is input as one frame, the QMF filter bank 21 outputs a spectral signal "spec (t, f) (t=0, 1, . . . , 31) (f=0, 1, . . . , 63)" in a frequency domain to the time/frequency grid generator 22 and respective parameter calculators 23, 25, 27, and 29. Spec (t, f) indicates a value in which 64 samples of frequency spectrum are arranged in a frequency direction f and 32 samples are arranged in a time direction t.

The time/frequency grid generator 22 arbitrarily divides the spectrum input from the QMF filter bank 21 into segments in the frequency direction and the time direction (a boundary between respective segments are referred to as a grid) to output initial grid information. Specifically, in the example mentioned above, upon reception of the input spectrum spec (t, f) from the QMF filter bank 21, the time/frequency grid generator 22 arbitrarily divides spec(t, f) into segments in the frequency direction and the time direction corresponding to a power distribution of the input spectrum spec(t, f), and outputs the initial grid information "init_grid(tg, fg)." When it is assumed that the number of segments in the time direction is "Nini" and the number of segments in the frequency direction is "Mini," the initial grid information is "init_grid(tg, fg) (tg=0, 1, . . . , Nini−1: fg=0, 1, . . . , Mini−1."

The time/frequency grid generator 22 then corrects the initial grid information "init_grid(tg, fg)" corresponding to a number-of-bit control signal "Bit_control," from the number-of-bit controller 32 described later, and outputs the initial grid information to the respective parameter calculators 23, 25, 27, and 29 as grid information "grid(tg, fg) (tg=0, 1, . . . , N−1: fg=0, 1, . . . , M−1)."

The spectral envelope calculator 23 calculates a characteristic parameter indicating a rough form of the input spectrum from a mean value of the input spectrum spec(t, f) included in the grid, and outputs the characteristic parameter to the spectral envelope coding unit 24 described later. Specifically, in the example mentioned above, the spectral envelope calculator 23 calculates spectral envelope information "E(grid(tg, fg))" for each grid "grid(tg, fg)" received from the time/frequency grid generator 22, and outputs the spectral envelope information to the spectral envelope coding 24.

The spectral envelope coding unit 24 encodes the characteristic parameter input from the spectral envelope calculator 23, and outputs the encoded data to the SBR multiplexer 33 described later. Specifically, in the example mentioned above, the spectral envelope coding unit 24 limits the number of grids corresponding to the number-of-bit control signal "Bit_control", from the number-of-bit controller 32, and outputs a spectral envelope code, "E_code(grid(tg, fg))," in which the spectral envelope information "E(grid(tg, fg))" for each grid "grid(tg, fg)" input from the spectral envelope calculator 23 is encoded, to the SBR multiplexer 33. A method for limiting the number of grids is arbitrary. However, for example, the number of bits of the spectral envelope code can be reduced by preferentially limiting the number of grids of high-frequency component in the frequency direction.

The noise floor calculator 25 calculates a characteristic parameter indicating an adjustment amount of a ratio between the tone component and the noise component of the high-frequency component of the input spectrum generated during an SBR decoding process, and outputs the characteristic parameter to the noise floor coding unit 26 described later. Specifically, in the example mentioned above, the noise floor calculator 25 calculates noise floor information, "Q(grid(tg, fg))," for each grid "grid(tg, fg)" input from the time/frequency grid generator 22, and outputs the noise floor information to the noise floor coding unit 26.

The noise floor coding unit 26 encodes the characteristic parameter indicating the adjustment amount of the ratio between the tone component and the noise component of the high-frequency component of the input spectrum input from the noise floor calculator 25, and outputs the encoded data to the SBR multiplexer 33. Specifically, in the example mentioned above, the noise floor coding unit 26 limits the number of encoding bits corresponding to number-of-bit control signal, "Bit_control", from the number-of-bit controller 32. Then, the noise floor coding unit 26 outputs a noise floor code, "Q_code(grid(tg, fg))," in which the noise floor information "Q(grid(tg, fg))" for each grid "grid(tg, fg)" input from the noise floor calculator 25 is encoded, to the SBR multiplexer 33. The method for limiting the number of encoding bits is arbitrary. However, for example, the number of bits of the noise floor code can be reduced by correcting the number of encoding bits to a fixed value such that the number of encoding bits becomes the smallest.

The inverse-filter level calculator 27 calculates a characteristic parameter indicating level information (for controlling a level to be removed) of an inverse filter for removing the tone component of the low-frequency component of the input signal, which is an element of high-frequency component during the SBR decoding process, and outputs the characteristic parameter to the inverse-filter level coding unit 28 described later. Specifically, in the example mentioned above, the inverse-filter level calculator 27 calculates inverse filter level information, "Inv_fil_level(grid(tg, fg)," for each grid "grid(tg, fg)" input from the time/frequency grid generator 22, and outputs the inverse filter level information to the inverse-filter level coding unit 28.

The inverse-filter level coding unit 28 encodes the characteristic parameter indicating the level information (for controlling level to be removed) of the inverse filter for removing the tone component of the low-frequency component of the signal input from the inverse-filter level calculator 27, and outputs the decoded data to the SBR multiplexer 33. Specifically, in the example mentioned above, the inverse-filter level coding unit 28 limits the number of encoding bits corresponding to the number-of-bit control signal, "Bit_control", input from the number-of-bit controller 32, and outputs an inverse filter level code, "Inv_fil_lev_code(grid(tg, fg))," in which the inverse filter level information "Inv_fil_level(grid(tg, fg))" input from the inverse-filter level calculator 27 is encoded, to the SBR multiplexer 33. The method for limiting the number of encoding bits is arbitrary. However, for example, the number of bits of the inverse filter level code can be reduced by deleting the encoded information (so that the encoded information is not transmitted).

The additional-sine frequency calculator 29 extracts the tone component of the input spectrum included in the grid, and calculates a characteristic parameter indicating the frequency information of a strong tone signal included in the spectrum to output the characteristic parameter to the additional-sine frequency coding unit 30 described later. Specifically, in the example mentioned above, the additional-sine frequency calculator 29 calculates additional sine frequency information, "Add_sine(grid(tg, fg))," for each grid "grid(tg, fg)" input from the time/frequency grid generator 22, and outputs the additional sine frequency information to the additional-sine frequency coding unit 30.

The additional-sine frequency coding unit 30 encodes the characteristic parameter indicating the frequency information of the strong tone signal included in the spectrum input from the additional-sine frequency calculator 29, and outputs the encoded data to the SBR multiplexer 33. Specifically, in the example mentioned above, the additional-sine frequency encoder 30 limits the number of encoding bits corresponding to the number-of-bit control signal "Bit_control" from the number-of-bit controller 32 to encode "Add_sine(grid(tg, fg))" input from the additional-sine frequency calculator 29, and outputs an additional sine frequency code, "Add_sine_code(grid(tg, fg))," to the SBR multiplexer 33. The method for limiting the number of encoding bits is arbitrary. However, for example, the number of bits of the additional-sine frequency code can be reduced by deleting the encoded information (so that the encoded information is not transmitted).

An upper-limit number-of-bit storage unit 31 stores the upper limit of the number of bits of the encoded data of high-frequency component finally generated in the high-pass encoding process. Specifically, in the example mentioned above, the upper-limit number-of-bit storage unit 31 stores an upper limit, "Available_bits," of the number of bits of the encoded data of high-frequency component generated by the spectral envelope coding unit 24, the noise floor coding unit 26, the inverse-filter level coding unit 28, and the additional-sine frequency coding unit 30, which are for the high-pass encoding process. The upper-limit number-of-bit storage unit 31 can store the upper limits by estimating the upper limit from the number of bits obtained by performing the high-pass encoding process halfway relative to the encoding target, or by estimating the upper limit from the number of bits obtained by completely performing the high-pass encoding process relative to the encoding target, or can preliminarily store the upper limit by receiving the upper limit from the external device.

The number-of-bit controller 32 controls the high-pass encoding process by preferentially encoding a parameter having a large influence to the sound quality relative to a plurality of parameters and not encoding a parameter having a small influence to the sound quality, so that the number of bits of the encoded data of high-frequency component finally generated in the high-pass encoding process becomes equal to or less than the upper limit to be stored in the upper-limit number-of-bit storage unit 31. Specifically, in the example mentioned above, the number-of-bit controller 32 obtains the upper limit (available number of bits "Available_bits") stored in the upper-limit number-of-bit storage unit 31, and outputs the number-of-bit control signal "Bit_control" based on used number of bits "Used_bits" output from the SBR multiplexer 33.

The SBR multiplexer 33 obtains the total number of encoding bits of the parameter code input from the respective parameter coding units to output the total number of encoding bits to the number-of-bit controller 32, and multiplexes the respective parameter codes to output the SBR code stream. Specifically, in the example mentioned above, the SBR multiplexer 33 obtains the total number of encoding bits "Used_bits" of the parameter codes input from the respective parameter coding units to output the total number of encoding bits to the number-of-bit controller 32, and multiplexes the respective parameter codes to output the respective parameter codes as the SBR code stream "sbr_code."

Figure 3:
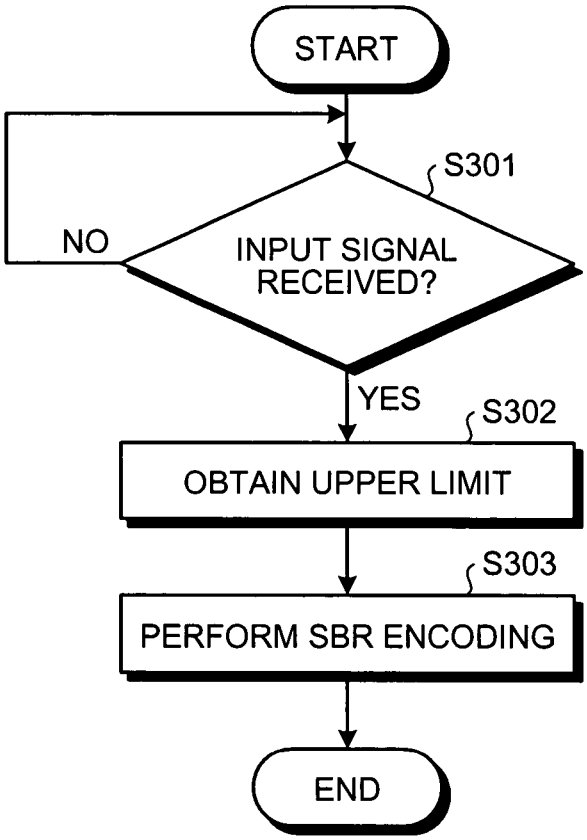
FIG. 3 is a flowchart of an encoding process in the SBR encoder according to the first embodiment.

A process performed by the SBR encoder is explained next with reference to FIG. 3. FIG. 3 is a flowchart of the encoding process in the SBR encoder according to the first embodiment.

As shown in FIG. 3, upon reception of the input signal (YES at step S301), the SBR encoder 20 obtains an SBR encoding upper limit from the upper-limit number-of-bit storage unit 31 (step S302). The SBR encoder 20 controls the high-pass encoding process by preferentially encoding the parameter having the large influence to the sound quality and not encoding the parameter having the small influence to the sound quality, so that the number of bits of the encoded data of high-frequency component finally generated in the high-pass encoding process becomes equal to or less than the upper limit to be stored in the upper-limit number-of-bit storage unit 31, thereby performing the SBR encoding process (step S303).

Specifically, in the example mentioned above, the upper-limit number-of-bit storage unit 31 preliminarily stores the upper limit. The time/frequency grid generator 22 outputs initial grid information from the input signal received by the QMF filter bank 21 to the respective parameter calculators (the spectral envelope calculator 23, the noise floor calculator 25, the inverse-filter level calculator 27, and the additional-sine frequency calculator 29).

The number-of-bit controller 32 controls the high-pass encoding process by preferentially encoding a parameter having the large influence to the sound quality and not encoding the parameter having the small influence to the sound quality, so that the number of bits of the encoded data of high-frequency component finally generated in the high-pass encoding process becomes equal to or less than the upper limit to be stored in the upper-limit number-of-bit storage unit 31.

The respective parameter calculators calculate the respective parameters from the received initial grid information, and output the respective parameters to the respective parameter coding units (the spectral envelope coding unit 24, the noise floor coding unit 26, the inverse-filter level coding unit 28, and the additional-sine frequency coding unit 30).

The respective parameter coding units encode the received parameters, and output the encoded data to the SBR multiplexer 33. The SBR multiplexer 33 obtains the total number of encoding bits of the parameter code input from the respective parameter coding units to output the total number of encoding bits to the number-of-bit controller 32, and multiplexes the respective parameter codes to output the SBR code stream.

In these examples, the upper limit is preliminarily stored. However, the present invention is not limited thereto, and the upper limit can be estimated from the used total number of bits after certain time has passed or can be estimated after completely performing the high-pass encoding process.

Thus, according to the first embodiment, the upper limit of the number of bits of the encoded data of high-frequency component finally generated in the high-pass encoding process is stored, the high-pass encoding process is controlled so that the number of bits of the encoded data of high-frequency component finally generated in the high-pass encoding process is equal to or less than the upper limit stored in the upper-limit number-of-bit storage unit 31. Accordingly, a local increase in the number of bits of the encoded data of high-frequency component can be avoided.

For example, when the core encoder that encodes the low-frequency component of the input signal and the SBR encoder 20 that encodes the high-frequency component of the input signal are combined and used relative to the input signal while assuming that the available number of encoding bits as a whole is "X," the number of bits used by the core encoder is "Y." and the number of bits used by the SBR encoder is "Z," it can be prevented that "Z" considerably increases relative to the whole number of bits "X" by determining the upper limit of "Z" and performing the SBR encoding so that the upper limit is not exceeded. Hence, the number of bits "Y" is ensured sufficiently, and as a result, encoding can be performed while preventing degradation of the sound quality.

According to the first embodiment, the upper limit received from the external device is preliminarily stored beforehand, and when the upper limit is stored in the upper-limit number-of-bit storage unit 31, the high-pass encoding process is controlled so that the number of bits is equal to or less than the upper limit. Accordingly, the time required for the encoding process can be reduced, as compared to when the upper limit is determined from the number of bits obtained by performing the high-pass encoding process for certain time or when the upper limit is estimated after executing the high-pass encoding process once.

According to the first embodiment, the high-pass encoding process is controlled by preferentially encoding the parameter having the large influence to the sound quality and not encoding the parameter having the small influence to the sound quality relative to the plurality of parameters. Accordingly, the number of bits required for encoding can be gradually reduced, and the encoded data of high-frequency component can be generated, with degradation of the sound quality being prevented.

For example, when it is assumed that the order of the parameters that affect the sound quality the most is parameter A, parameter B, parameter C, and parameter D, the parameters are encoded in order from parameter A, and when the upper limit of the number of bits is reached, the parameters thereafter are discarded. Accordingly, the encoded data of high-frequency component can be generated, with degradation of the sound quality being prevented.

In the first embodiment, it is explained that the parameter having a large influence to the sound quality is preferentially encoded, as for controlling the number of bits of the encoded data of high-frequency component to be equal to or less than the upper limit. However, the present invention is not limited thereto, and the number of grids in the frequency or time direction in the frame can be reduced.

Figure 4A:
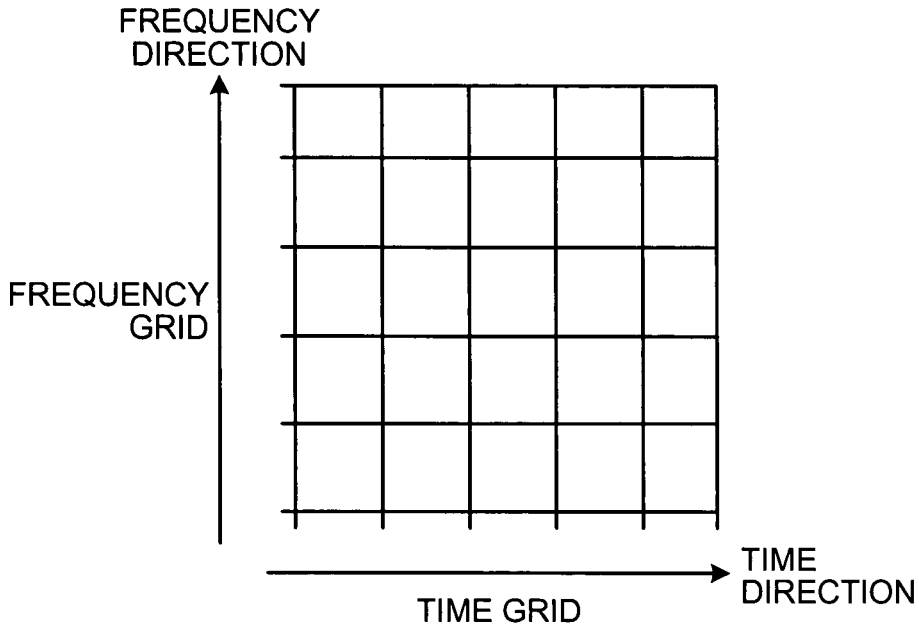
FIG. 4A is a schematic diagram for explaining an outline and characteristics of an SBR encoder according to a second embodiment of the present invention.
Figure 4B:
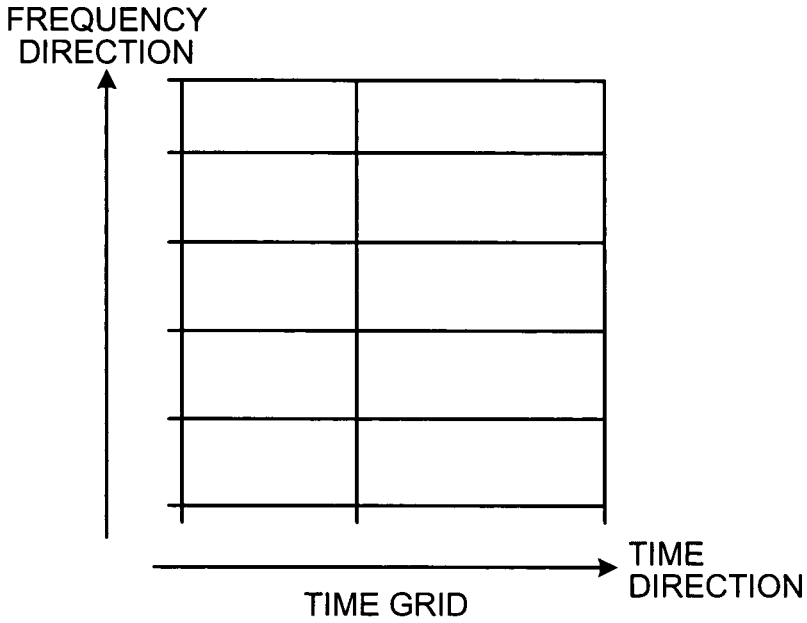
FIG. 4B is a schematic diagram for explaining the outline and the characteristics of the SBR encoder according to the second embodiment of the present invention

In a second embodiment of the present invention, therefore, it is explained that the number of grids in the frequency or time direction in the frame is reduced, as for controlling the number of bits of the encoded data of high-frequency component to be equal to or less than the upper limit, with reference to FIGS. 4A and 4B. An outline and characteristics of an SBR encoder according to the second embodiment, and the effects of the second embodiment are explained in this order.

The outline and the characteristics of the SBR encoder according to the second embodiment are explained with reference to FIGS. 4A and 4B. FIGS. 4A and 4B are schematic diagrams for explaining the outline and the characteristics of the SBR encoder according to the second embodiment.

The SBR encoder includes the upper-limit number-of-bit storage unit that stores the upper limit of the number of the bits of the encoded data of high-frequency component finally generated in the high-pass encoding process. Upon reception of the input signal, the SBR encoder controls the high-pass encoding process so that the number of bits of the encoded data of high-frequency component finally generated in the high-pass encoding process becomes equal to or less than the upper limit stored in the upper-limit number-of-bit storage unit. That is, the SBR encoder controls the high-pass encoding process to reduce the number of grids in the frequency or time direction in the frame relative to the parameters.

To specifically explain with an example, the SBR encoder normally adjusts the frequency grid and the time grid to divide the input signal as shown in FIG. 4A. When it is assumed herein that one parameter (1 bit) is required for encoding the one divided grid, 25 parameters (25 bits) are required in FIG. 4A. However, as shown in FIG. 4B, when the time grid is changed to a long interval than normal to divide the input signal into 10 grids, only 10 parameters (10 bits) are required in total.

In FIGS. 4A and 4B, the SBR encoder of when the time grid is made long has been explained. However, the present invention is not limited thereto, and the frequency grid can be made long, or both of the frequency grid and the time grid can be made long.

Thus, according to the SBR encoder in the second embodiment, the high-pass encoding process is performed relative to the respective parameters by increasing the grid width in the time direction (by reducing the number of grids). As a result, the encoded data of high-frequency component having small number of bits can be generated, while preventing degradation of the sound quality.

Units that performs the above process is explained with reference to FIG. 2. The number-of-bit controller 32 instructs the time/frequency grid generator 22 to divide the input signal into 10 grids, and the time/frequency grid generator 22 outputs the grid information, in which the input signal is divided into 10 grids, to the respective parameter calculators. The respective parameter calculators and respective parameter coding units encode the parameter calculated based on the grid information.

Thus, according to the second embodiment, the high-pass encoding process is controlled by reducing the number of grids in the frequency or time direction in the frame relative to the parameters. Accordingly, the encoded data of high-frequency component having small number of bits can be generated, while preventing degradation of the sound quality. For example, the high-pass encoding process is performed relative to the respective parameters by increasing the grid width (by decreasing the number of grids) in the time direction. Accordingly, the encoded data of high-frequency component having smaller number of bits can be generated, as compared to when nothing is controlled, and the encoded data of high-frequency component having good sound quality can be generated, as compared to when the parameters are replaced by the number of bits having less information amount.

In the first embodiment, the parameter having a large influence to the sound quality is preferentially encoded as for controlling the number of bits so that the number of bits of the encoded data of high-frequency component becomes equal to or less than the upper limit. However, the present invention is not limited thereto, and a parameter belonging to a frequency component below a predetermined frequency can be preferentially encoded.

In a third embodiment of the present invention, the parameter belonging to a frequency component below the predetermined frequency is preferentially encoded as for controlling the number of bits of the encoded data of high-frequency component to be equal to or less than the upper limit, with reference to FIG. 5. An outline and characteristics of the SBR encoder according to the third embodiment, and the effects of the third embodiment are explained in this order.

The outline and the characteristics of the SBR encoder according to the third embodiment are explained with reference to FIG. 5. FIG. 5 is a schematic diagram for explaining the outline and the characteristics of the SBR encoder according to the third embodiment.

The SBR encoder includes the upper-limit number-of-bit storage unit that stores the upper limit of the number of the bits of the encoded data of high-frequency component finally generated in the high-pass encoding process. Upon reception of the input signal, the SBR encoder controls the high-pass encoding process so that the number of bits of the encoded data of high-frequency component finally generated in the high-pass encoding process becomes equal to or less than the upper limit stored in the upper-limit number-of-bit storage unit, by preferentially encoding the parameter belonging to the frequency component below the predetermined frequency, relative to a plurality of parameters.

Figure 5:
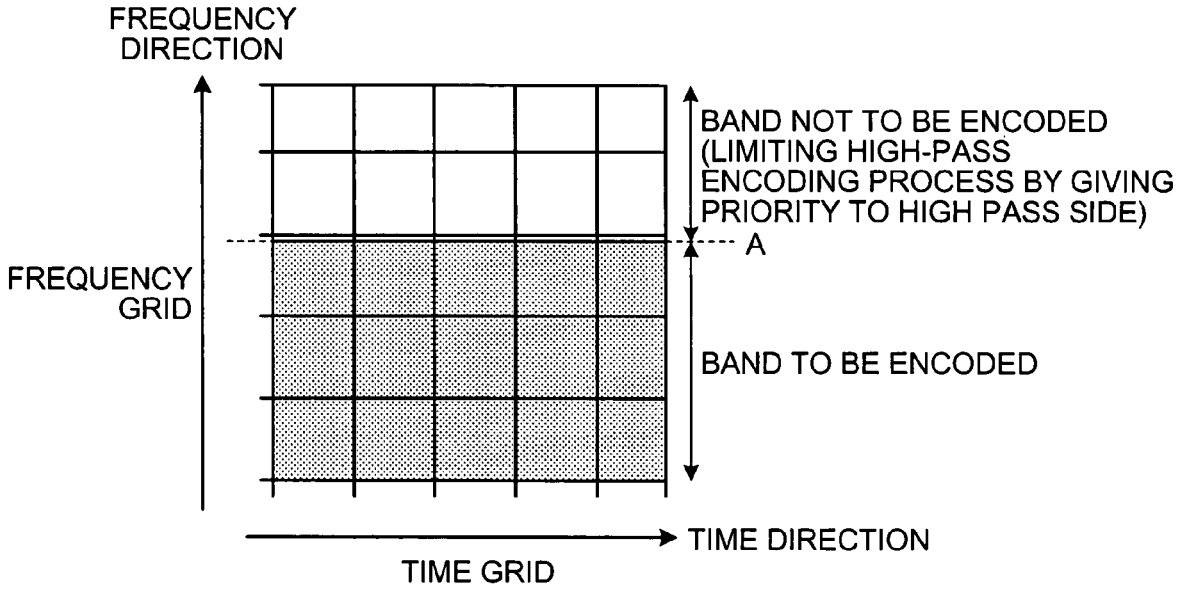
FIG. 5 is a schematic diagram for explaining an outline and characteristics of an SBR encoder according to a third embodiment of the present invention.

Specifically, for example, the SBR encoder normally adjusts the frequency grid and the time grid to divide the input signal as shown in FIG. 5. When it is assumed that one parameter (1 bit) is required for encoding one divided grid, 25 parameters (25 bits) are required in FIG. 5. However, when the high-pass encoding process is controlled such that a grid equal to or lower than "A" of the frequency grid is encoded (and a grid of a frequency higher than "A" is not encoded), 15 parameters (15 bits) in total are required for encoding in FIG. 5.

Thus, the SBR encoder according to the third embodiment determines the component to be encoded and the component not to be encoded relative to each parameter as fine adjustment, thereby enabling encoding of all the parameters well under the upper limit of the number of bits. As a result, fine adjustment such as giving priority to the sound quality or to the number of bits becomes possible.

Units that perform the above process are explained with reference to FIG. 2. The number-of-bit controller 32 instructs the respective parameter calculators to encode the grids equal to or lower than "A" of the frequency grid (not to encode the grids higher than frequency "A"). The respective parameter calculators and respective parameter coding units encode the parameter calculated based on the instruction.

Thus, according to the third embodiment, by preferentially encoding the parameter belonging to the frequency component below the predetermined frequency relative to the parameters, the high-pass encoding process is controlled. Hence, fine adjustment such as giving priority to the sound quality or to the number of bits becomes possible. For example, as the fine adjustment, all the parameters can be encoded well under the upper limit of the number of bits by determining the component to be encoded and the component not to be encoded relative to the respective parameters. Accordingly, the encoded data of high-frequency component can be generated with degradation of sound quality being prevented, and the encoded data of high-frequency component having smaller number of bits can be generated, as compared to when any control is not performed.

In the first to the third embodiments, only the SBR encoder that generates the encoded data of high-frequency component has been explained. However, the present invention is not limited thereto, and the SBR encoder and the core encoder can be combined.

In a fourth embodiment of the present invention, therefore, an encoding system formed of the SBR encoder and the core encoder is explained with reference to FIG. 6. An outline and characteristics of the encoding system according to the fourth embodiment, and the effects of the fourth embodiment are explained in this order.

A configuration of the encoding system according to the fourth embodiment is explained with reference to FIG. 6. FIG. 6 is a block diagram of the configuration of the encoding system according to the fourth embodiment.

Figure 6:
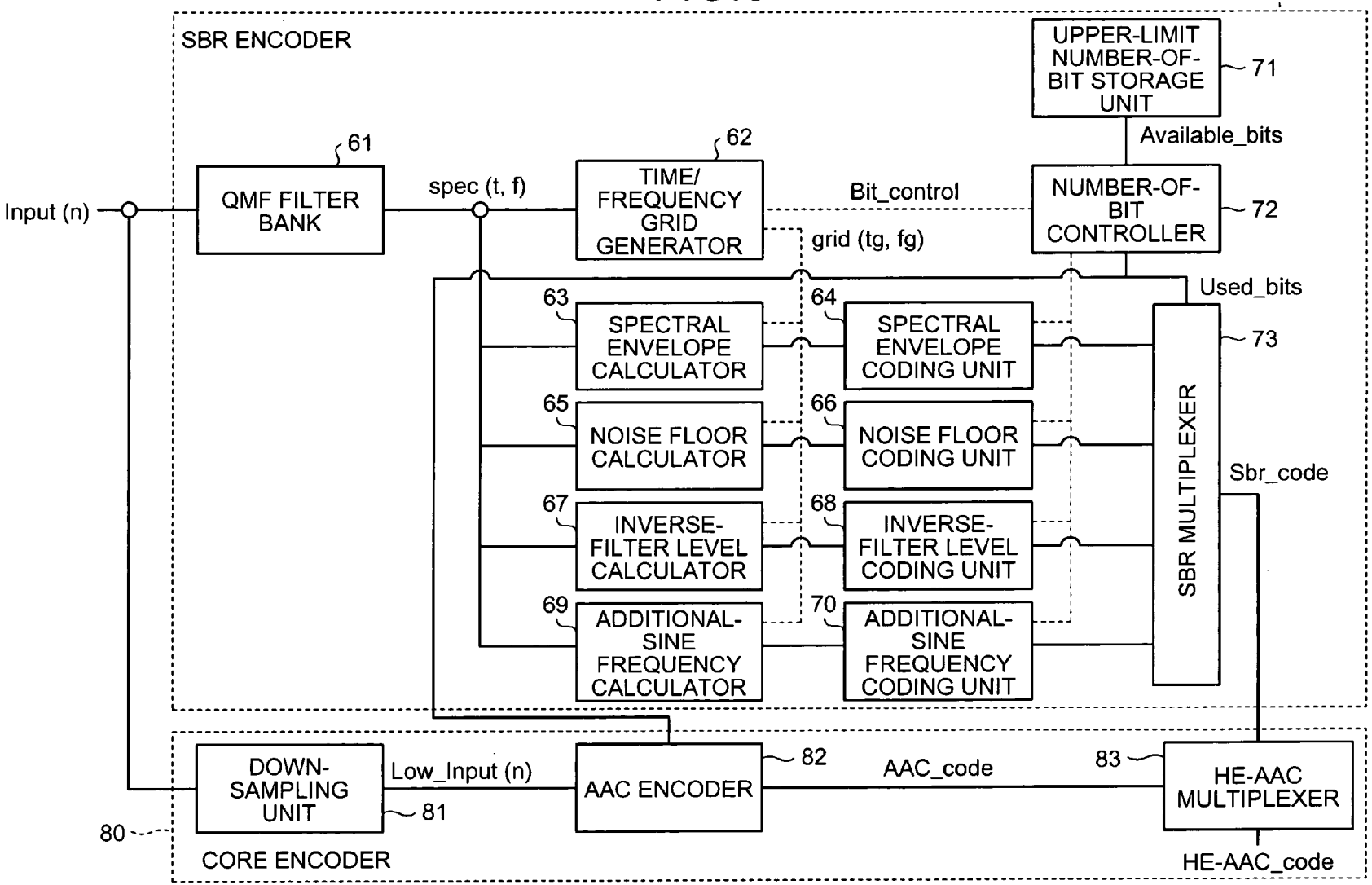
FIG. 6 is a block diagram of a configuration of an encoding system according to a fourth embodiment of the present invention.

As shown in FIG. 6, the encoding system is configured by an SBR encoder 60 and a core encoder 80. The SBR encoder 60 has the same configuration and function as the SBR encoder 20 explained in the first embodiment. That is, a QMF filter bank 61, a time/frequency grid generator 62, a spectral envelope calculator 63, a spectral envelope coding unit 64, a noise floor calculator 65, a noise floor coding unit 66, an inverse-filter level calculator 67, an inverse-filter level coding unit 68, an additional-sine frequency calculator 69, an additional-sine frequency coding unit 70, an upper-limit number-of-bit storage unit 71, a number-of-bit controller 72, and an SBR multiplexer 73 in the SBR encoder 60 have the same configuration as the QMF filter bank 21, the time/frequency grid generator 22, the spectral envelope calculator 23, the spectral envelope coding unit 24, the noise floor calculator 25, the noise floor coding unit 26, the inverse-filter level calculator 27, the inverse-filter level coding unit 28, the additional-sine frequency calculator 29, the additional-sine frequency coding unit 30, the upper-limit number-of-bit storage unit 31, the number-of-bit controller 32, and the SBR multiplexer 33 in the SBR encoder 20 explained in the first embodiment. Thus, detailed explanations thereof will be omitted.

The core encoder 80 is explained below. The core encoder 80 includes a down-sampling unit 81, an AAC encoder 82, and an HE-AAC multiplexer 83. The down-sampling unit 81 down-samples the input signal, and outputs a low-frequency component of the input signal to the AAC encoder 82 described later. Specifically, as an example, the down-sampling unit 81 down-samples an input signal "input(n)" of 2048 samples to a ½ sampling frequency and outputs a low-pass input signal "low_input(n) (n=0, 1, . . . , 1023)" of 1024 samples to the AAC encoder 82.

The AAC encoder 82 generates the encoded data of low-frequency component to fit in the number of bits allocated to the core encoder 80. Specifically, when it is assumed that the total number of bits available to both of the SBR encoder 60 and the core encoder 80 is "he_aac_available_bit," a result obtained by subtracting the number of bits "used_bit" used by the SBR encoder 60 from the total number of bits is an upper limit "aac_available_bit" of the number of bits allocated to the core encoder 80. The AAC encoder 82 encodes the input signal of low-frequency component "low_input(n)" so that AAC-encoded number of bits "aac_used_bits" fits in the upper limit "aac_available_bit," and outputs an AAC code "AAC_code" to the HE-AAC multiplexer 83.

The HE-AAC multiplexer 83 multiplexes the encoded data of low-frequency component and the encoded data of high-frequency component, and transmits the encoded data to the external device. Specifically, in the example mentioned above, the HE-AAC multiplexer 83 transmits an HE-AAC code "HE-AAC_code" obtained by multiplexing an SBR code "Sbr_code," which is the encoded data of high-frequency component generated by the SBR encoder 60, and the AAC code "AAC_code," which is the encoded data of low-frequency component generated by the core encoder 80, to the external device.

Thus, according to the fourth embodiment, the SBR encoder is connected to the core encoder that performs the low-pass encoding process indicating a series of processes for generating the encoded data of low-frequency component from the low-frequency component of the input signal, and the core encoder multiplexes the encoded data of low-frequency component and the encoded data of high-frequency component to transmit these encoded data to the external device. Accordingly, the encoded data including the information of the entire input signal can be efficiently transmitted, as compared to when the low-frequency component of input signal and the high-frequency component of input signal are encoded by separate apparatuses.

While the embodiments of the present invention have been explained above, the present invention can be performed in various different embodiments other than the embodiments described above. Hence, as shown below, different embodiments are explained in terms of division of the time/frequency grid generator, control of number of bits in the high-pass encoding process, calculation of the upper limit, system configuration and the like, and program.

Figure 7:
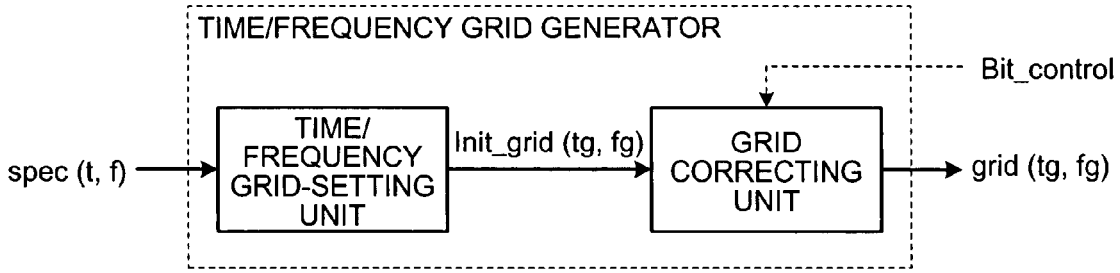
FIG. 7 is an example when a time/frequency grid generator is divided.

For example, the time/frequency grid generator shown in the first to the fourth embodiments can be divided into a time/frequency grid-setting unit and a grid correcting unit, while taking a processing mode into consideration. If the time/frequency grid generator is divided in this manner, the time/frequency grid-setting unit arbitrarily divides the input spectrum spec(t, f) into segments in the frequency direction and the time direction corresponding to power distribution of the spec(t, f) and outputs the initial grid information "init_grid(tg, fg)." The grid correcting unit corrects the initial grid information "init_grid(tg, fg)" corresponding to the number-of-bit control signal, "Bit_control", from the number-of-bit controller and outputs the grid information "grid(tg, fg) (tg=0, 1, . . . , N−1: fg=0, 1, . . . , M−1)" to the respective parameter calculators. While the correction method is arbitrary, the initial grid information is corrected so that N is equal to or less than Nini (N≤Nini), and M is equal to or less than Mini (M≤Mini), and the number of parameters to be encoded is reduced to reduce the number of encoded bits. FIG. 7 is an example when the time/frequency grid generator is divided.

In the first embodiment, the parameter having a large influence to the sound quality is preferentially encoded as the number-of-bit control in the high-pass encoding process. However, the present invention is not limited thereto, and the high-pass encoding process (the number of bit) can be controlled by replacing the generated encoded data of high-frequency component by a smaller information amount. In this manner, the encoded data of high-frequency component having considerably small number of bits can be generated. For example, the encoded data of high-frequency component having considerably small number of bits can be generated by not performing the high-pass encoding process or by encoding the minimum information that can be encoded at a transmission destination of the encoded data of high-frequency component.

In the first to the fourth embodiments, the upper limit of the number of bits of the encoded data of high-frequency component finally generated in the high-pass encoding process is preliminarily stored. However, the present invention is not limited thereto, and the upper limit can be estimated from the number of bits obtained by performing the high-pass encoding process halfway relative to the encoding target and stored. For example, the upper limit can be estimated from the used total number of bits after certain time has passed.

In this manner, for example, the encoding target can be encoded halfway, to calculate the number of bits consumed so far, and the upper limit can be determined relative to the available total number of bits from the calculation result, thereby avoiding a local increase of the number of encoding bits to be used more accurately.

The upper limit can be estimated from the number of bits obtained by completely performing the high-pass encoding process relative to the encoding target and stored. Accordingly, for example, because the upper limit is determined from the number of bits obtained by performing the high-pass encoding process once, a local increase of the number of bits of the encoded data of high-frequency component can be avoided more accurately, as compared to when the upper limit is determined from the number of bits obtained by performing the high-pass encoding process until certain time has passed.

When the encoding system including the core encoder and the SBR encoder is used, the upper limit can be estimated from the number of bits of the encoded data of low-frequency component finally generated in the low-pass encoding process and stored. In this manner, efficient bit distribution can be performed at the time of determining the number of bits for the low-pass encoding process and the high-pass encoding process. For example, when a large number of bits is used in the high-pass encoding process, the number of bits available in the low-pass encoding process decreases, thereby causing degradation of the sound quality as a whole. However, the low-pass encoding process can be performed first and the upper limit of the number of bits to be used in the high-pass encoding process can be determined thereafter. As a result, efficient bit distribution can be performed.

The respective constituent elements of the respective devices shown in the drawings are functionally conceptual, and physically the same configuration is not always necessary. That is, the specific mode of distribution and integration of the devices is not limited to the shown ones, and all or a part thereof can be functionally or physically distributed or integrated in an optional unit (such as integrating the time/frequency grid generator 22 and the number-of-bit controller 32) according to various kinds of load and the status of use. Further, all or an optional part of various process functions performed by the respective devices can be realized by a central processing unit (CPU) or a program analyzed and executed by the CPU, or can be realized as hardware by the wired logic. In addition, the process procedures, control procedures, specific names, and information including various kinds of data and parameters shown in the present specification or the drawings can be optionally changed unless otherwise specified.

The various processes explained in the embodiments can be realized by executing a program preliminarily prepared by a computer system such as a personal computer and a workstation. An example of the computer system that executes the program having the same functions as in the embodiments is explained below.

Figure 8:
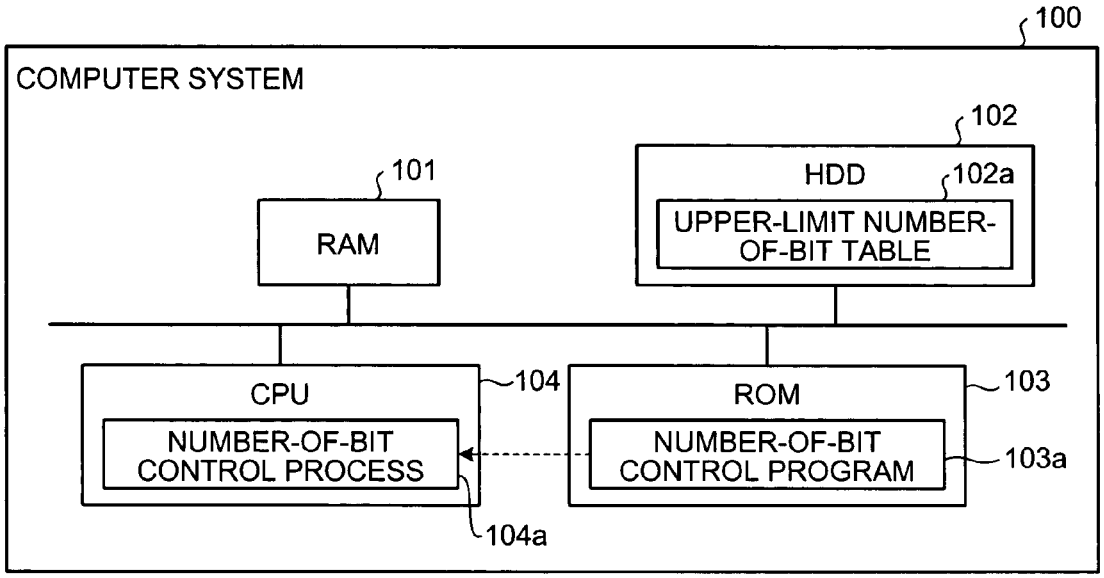
FIG. 8 is an example of a computer system that executes an encoding program.
Figure 9:
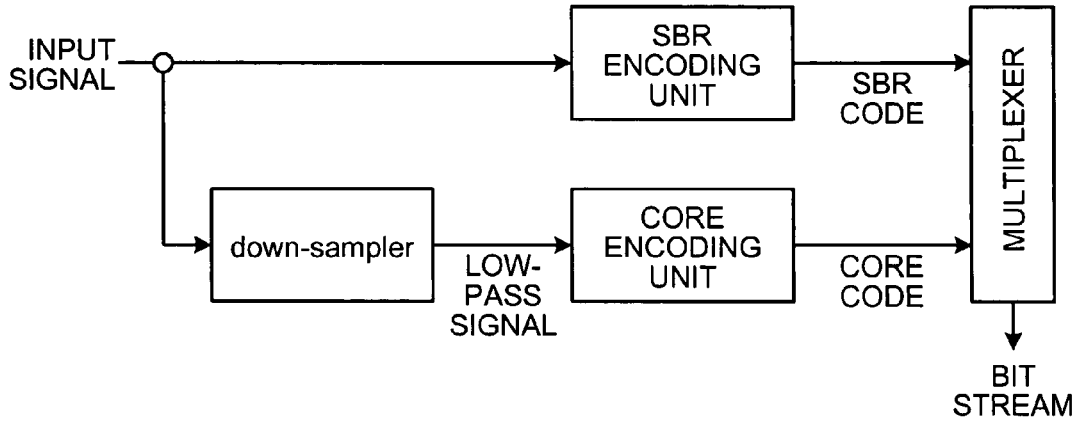
FIG. 9 is a schematic diagram for explaining a conventional technique.
Figure 10:
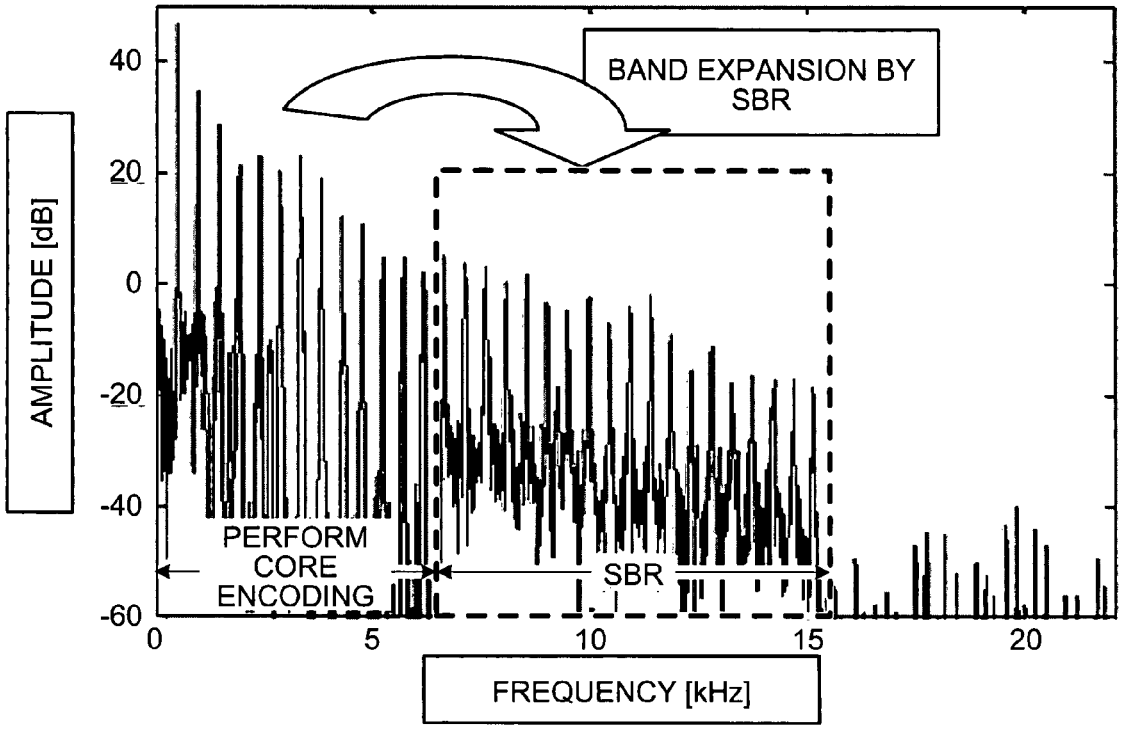
FIG. 10 is another schematic diagram for explaining a conventional technique.
Figure 11:
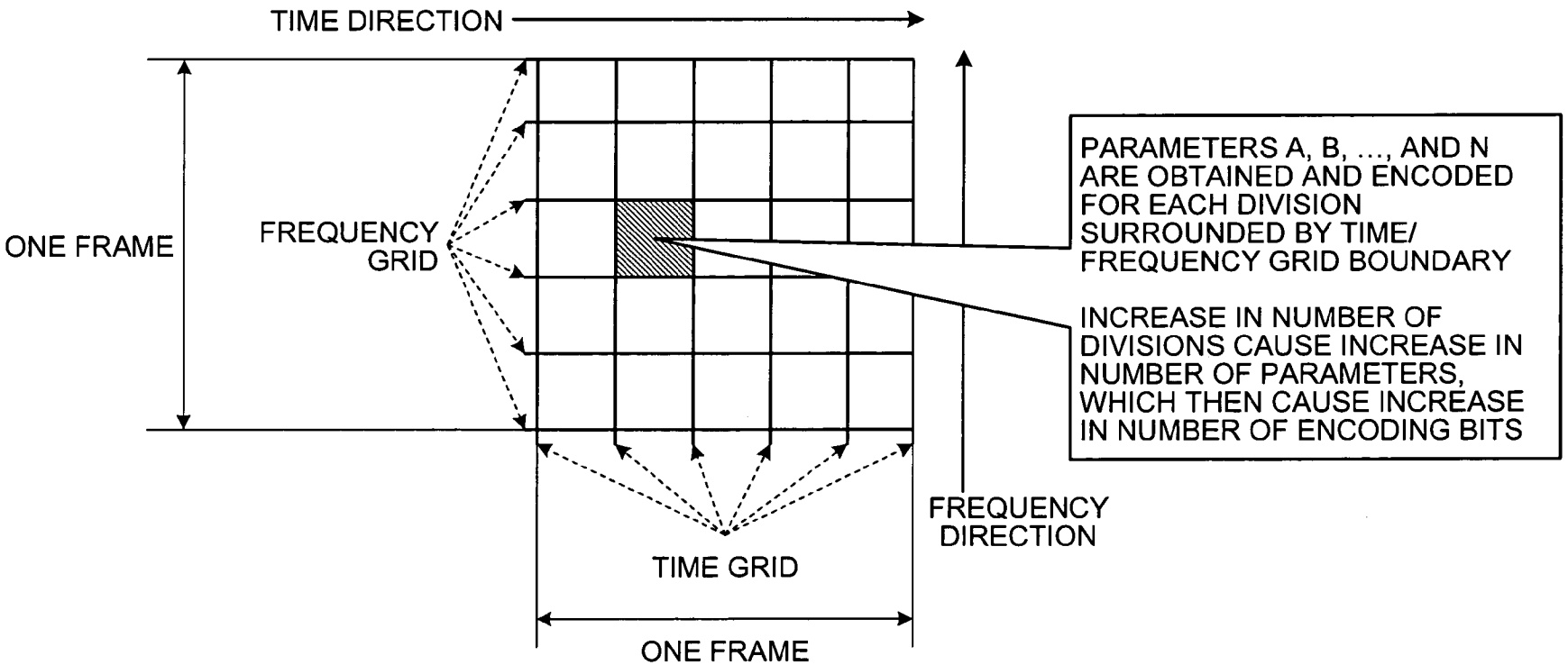
FIG. 11 is still another schematic diagram for explaining a conventional technique.
Figure 12:
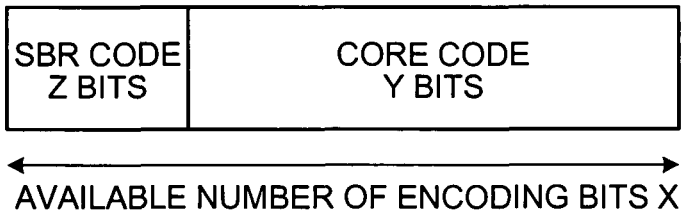
FIG. 12 is still another schematic diagram for explaining a conventional technique.
Figure 13:
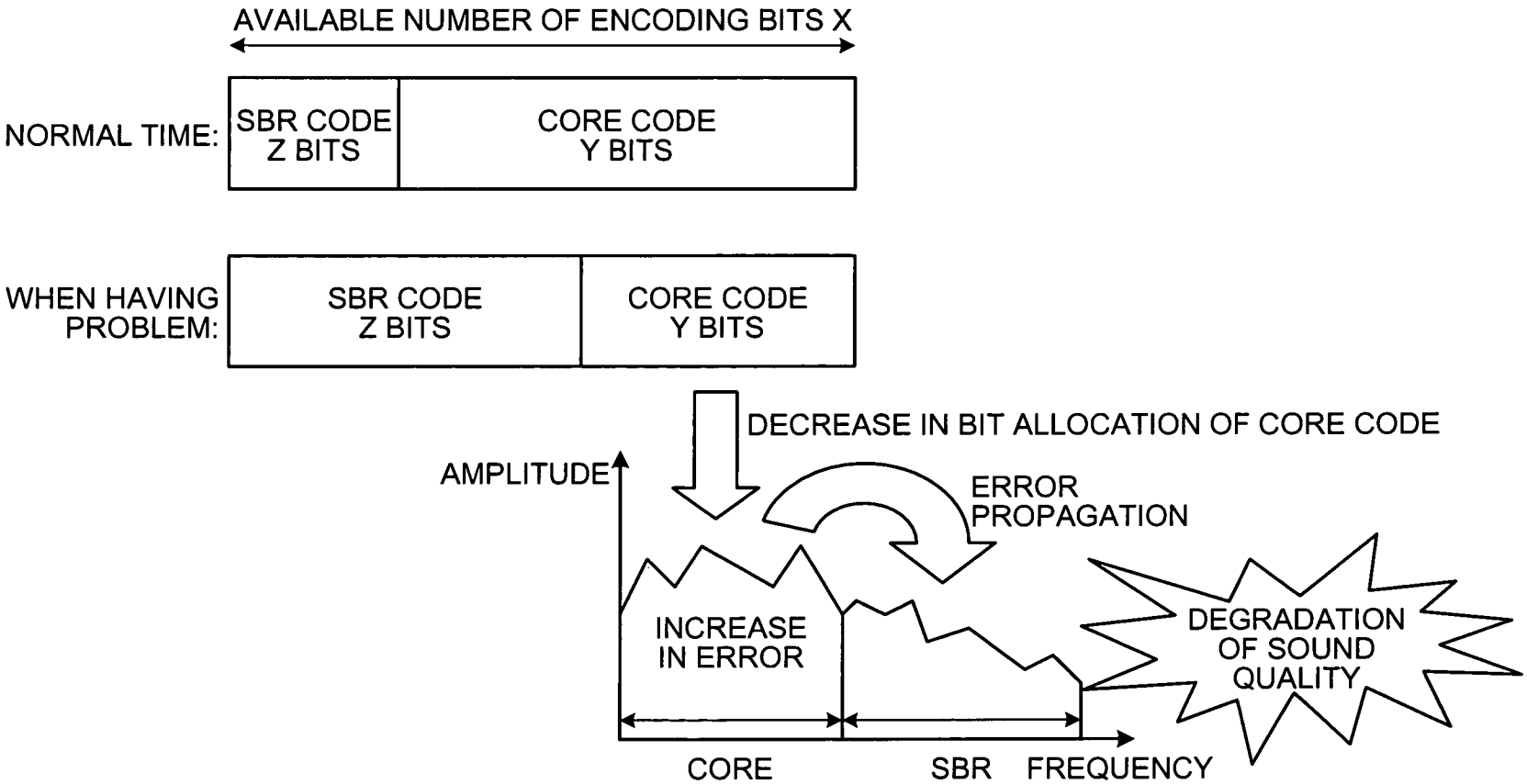
FIG. 13 is still another schematic diagram for explaining a conventional technique.

FIG. 8 is an example of the computer system that executes the encoding program. As shown in FIG. 8, a computer system 100 includes a random access memory (RAM) 101, a hard disk drive (HDD) 102, a read only memory (ROM) 103, and a CPU 104. A program for demonstrating the same functions as in the embodiments explained above, that is, as shown in FIG. 8, a number-of-bit control program 103*a* is preliminarily stored in the ROM 103.

The CPU 104 reads and executes the number-of-bit control program 103*a* to realize a number-of-bit control process 104*a* as shown in FIG. 8. The number-of-bit control process 104*a* corresponds to the number-of-bit controller 32 shown in FIG. 2.

An upper-limit number-of-bit table 102*a* that stores the upper limit of the number of bit of the encoded data of high-frequency component finally generated in the high-pass encoding process is provided in the HDD 102. The upper-limit number-of-bit table 102*a* corresponds to the upper-limit number-of-bit storage unit 31 shown in FIG. 2.

The number-of-bit control program 103*a* is not necessarily stored in the ROM 103. For example, the number-of-bit control program 103*a* can be stored on a "fixed physical medium" such as a hard disk drive (HDD) provided inside or outside of the computer system 100, and in "another computer system" connected to the computer system 100 via a public line, the Internet, a local area network (LAN), or a wide area network (WAN), as well as on a "portable physical medium", such as a flexible disk (FD), a compact disk (CD)-ROM, a magneto-optical disk (MO-disk), a DVD, a magnetic optical disk, or and an integrated circuit (IC) card, to be inserted in the computer system 100, and the computer system 100 can read and execute the program.

According to one aspect of the present invention, the upper limit of the number of bit of the encoded data of high-frequency component finally generated in the high-pass encoding process is stored to control the high-pass encoding process so that the number of bits of the encoded data of high-frequency component finally generated in the high-pass encoding process becomes equal to or less than the upper limit to be stored. Accordingly, a local increase of the number of bits of the encoded data of high-frequency component can be avoided.

For example, when the core encoder that encodes the low-frequency component of the input signal and the SBR encoder 20 that encodes the high-frequency component of the input signal are combined and used relative to the input signal while assuming that the available number of encoding bits as a whole is "X," the number of bits used by the core encoder is "Y." and the number of bits used by the SBR encoder is "Z." it can be prevented that "Z" considerably increases relative to the whole number of bits "X" by determining the upper limit of "Z" and performing the SBR encoding so that the upper limit is not exceeded. Hence, the number of bits "Y" is ensured sufficiently, and as a result, encoding can be performed while preventing degradation of the sound quality.

According to another aspect of the present invention, the high-pass encoding process relative to the parameters is controlled by reducing the number of grids in the frequency or time direction in the frame, relative to a plurality of parameters. Accordingly, the encoded data of high-frequency component having small number of bits can be generated, while preventing degradation of the sound quality.

For example, the high-pass encoding process is performed relative to the respective parameters by increasing the grid width (by decreasing the number of grids) in the time direction. Accordingly, the encoded data of high-frequency component having smaller number of bits can be generated, as compared to when nothing is controlled, and the encoded data of high-frequency component having good sound quality can be generated, as compared to when the parameters are simply replaced by the number of bits having less information amount.

According to still another aspect of the present invention, by preferentially encoding the parameter having a large effect to the sound quality and not encoding the parameter having a small effect to the sound quality relative to a plurality of parameters, the high-pass encoding process is controlled. Accordingly, the number of bits required for encoding can be gradually reduced, and the encoded data of high-frequency component can be generated with degradation of the sound quality being further prevented.

For example, when it is assumed that the order of the parameters that affect the sound quality the most is parameter A, parameter B, parameter C, and parameter D, the parameters are encoded in order from parameter A. When the upper limit of the number of bits is reached, the parameters thereafter are discarded. Accordingly, the encoded data of high-frequency component can be generated, with degradation of the sound quality being prevented.

According to still another aspect of the present invention, the parameter belonging to a frequency component below a predetermined frequency is preferentially encoded relative to the parameters, thereby controlling the high-pass encoding process. Accordingly, fine adjustment such as giving priority to the sound quality or to the number of bits becomes possible.

For example, as the fine adjustment, the component to be encoded and the component not to be encoded are determined relative to the respective parameters, thereby enabling encoding of all the parameters well under the upper limit of the number of bits. Accordingly, the encoded data including the information of the entire input signal can be efficiently transmitted, as compared to when the parameter having a large effect to the sound quality is preferentially encoded or when the number of grids in the frequency or time direction in the frame is reduced.

According to still another aspect of the present invention, the low-pass encoding process for generating the encoded data of low-frequency component from the low-frequency component of the input signal and the generated encoded data of low-frequency component is performed, and the generated encoded data of low frequency component and the generated encoded data of high frequency component generated by the high-pass encoding process are multiplexed and transmitted to the external device. Accordingly, the encoded data including the information of the entire input signal can be efficiently transmitted, as compared to when the low-frequency component and high-frequency component of the input signal are encoded by separate apparatuses.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An encoder that performs a high-pass encoding process for an input signal divided into frames formed of certain samples, comprising:

an upper-limit number-of-bit storage unit that stores an upper limit of a number of bits of encoded data of a high-frequency component in the input signal finally generated in the high-pass encoding process where a plurality of parameters indicating characteristics of the high-frequency component in the input signal are calculated;

a number-of-bit controller that controls the high-pass encoding process so that the number of bits of the encoded data of the high-frequency component finally generated in the high-pass encoding process becomes equal to or less than the upper limit stored in the upper-limit number-of-bit storage unit; and a number-of-bit estimating unit that estimates the upper limit from a number of bits obtained by calculating a parameter from the plurality of parameters in the high-pass encoding process of an encoding target, and stores the upper limit in the upper-limit number-of-bit storage unit, wherein the number-of-bit controller controls the high-pass encoding process so that the number of bits of the encoded data becomes equal to or less than the upper limit when the upper limit is stored in the upper-limit number-of-bit storage unit by the number-of-bit estimating unit.

2. The encoder according to claim 1, wherein the number-of-bit controller controls the high-pass encoding process by replacing the encoded data of the high-frequency component finally generated in the high-pass encoding process by encoded data of the high-frequency component formed of the number of bits equal to or less than the upper limit.

3. The encoder according to claim 1, wherein the number-of-bit controller controls, relative to the parameters, the high-pass encoding process by reducing a number of grids in a frequency or time direction in the frames.

4. The encoder according to claim 1, wherein the number-of-bit controller controls, relative to the parameters, the high-pass encoding process by preferentially encoding a parameter having a large influence to sound quality and not encoding a parameter having a small influence to the sound quality.

5. The encoder according to claim 1, wherein the number-of-bit controller controls, relative to the parameters, the high-pass encoding process by preferentially encoding a parameter belonging to a frequency component below a predetermined frequency.

6. The encoder according to claim 1, further comprising a low-pass encoder that performs a low-pass encoding process for generating encoded data of a low-frequency component from a low-frequency component in the input signal; and a multiplexer that multiplexes the encoded data of the low-frequency component generated by the low-pass encoder and the encoded data of the high-frequency component generated in the high-pass encoding process, and transmits the multiplexed data to an external device.

7. The encoder according to claim 6, wherein the number-of-bit estimating unit estimates the upper limit from a number of bits of the encoded data of the low-frequency component finally generated by the low-pass encoding process and stores the upper limit in the upper-limit number-of-bit storage unit, and the number-of-bit controller controls the high-pass encoding process so that the number of bits becomes equal to or less than the upper limit when the upper limit is stored in the upper-limit number-of-bit storage unit by the number-of-bit estimating unit.

8. An encoder that performs a high-pass encoding process for an input signal divided into frames formed of certain samples, comprising:

an upper-limit number-of-bit storage unit that stores an upper limit of a number of bits of encoded data of a high-frequency component in the input signal finally generated in the high-pass encoding process where a plurality of parameters indicating characteristics of the high-frequency component in the input signal are calculated;

a number-of-bit controller that controls the high-pass encoding process so that the number of bits of the encoded data of the high-frequency component finally generated in the high-pass encoding process becomes equal to or less than the upper limit stored in the upper-limit number-of-bit storage unit; and a number-of-bit estimating unit that estimates the upper limit from a number of bits obtained by calculating all of the plurality of parameters in the high-pass encoding process of an encoding target, and stores the upper limit in the upper-limit number-of-bit storage unit, wherein the number-of-bit controller controls the high-pass encoding process so that the number of bits of the encoded data becomes equal to or less than the upper limit when the upper limit is stored in the upper-limit number-of-bit storage unit by the number-of-bit estimating unit.

9. The encoder according to claim 8, further comprising a low-pass encoder that performs a low-pass encoding process for generating encoded data of a low-frequency component from a low-frequency component in the input signal; and a multiplexer that multiplexes the encoded data of the low-frequency component generated by the low-pass encoder and the encoded data of the high-frequency component generated in the high-pass encoding process, and transmits the multiplexed data to an external device.

10. The encoder according to claim 9, wherein the number-of-bit estimating unit estimates the upper limit from a number of bits of the encoded data of the low-frequency component finally generated by the low-pass encoding process and stores the upper limit in the upper-limit number-of-bit storage unit, and the number-of-bit controller controls the high-pass encoding process so that the number of bits becomes equal to or less than the upper limit when the upper limit is stored in the upper-limit number-of-bit storage unit by the number-of-bit estimating unit.

11. The encoder according to claim 8, wherein the number-of-bit controller controls the high-pass encoding process by replacing the encoded data of the high-frequency component finally generated in the high-pass encoding process by encoded data of the high-frequency component formed of the number of bits equal to or less than the upper limit.

12. The encoder according to claim 8, wherein the number-of-bit controller controls, relative to the parameters, the high-pass encoding process by reducing a number of grids in a frequency or time direction in the frames.

13. The encoder according to claim 8, wherein the number-of-bit controller controls, relative to the parameters, the high-pass encoding process by preferentially encoding a parameter having a large influence to sound quality and not encoding a parameter having a small influence to the sound quality.

14. The encoder according to claim 8, wherein the number-of-bit controller controls, relative to the parameters, the high-pass encoding process by preferentially encoding a parameter belonging to a frequency component below a predetermined frequency.

15. An encoding method that performs a high-pass encoding process for an input signal divided into frames formed of certain samples, comprising:

a first storing of an upper limit of a number of bits of encoded data of a high-frequency component in the input signal finally generated in the high-pass encoding process where a plurality of parameters indicating characteristics of the high-frequency component in the input signal are calculated;

controlling the high-pass encoding process so that the number of bits of the encoded data of the high-frequency component finally generated in the high-pass encoding process becomes equal to or less than the upper limit stored at the first storing; and estimating the upper limit from a number of bits obtained by calculating a parameter from the plurality of parameters in the high-pass encoding process of an encoding target, and a second storing of the upper limit, wherein the controlling includes controlling the high-pass encoding process so that the number of bits of the encoded data becomes equal to or less than the upper limit when the upper limit is stored at the second storing.

16. A non-transitory computer-readable recording medium that stores therein a computer program performing a high-pass encoding process for an input signal divided into frames formed of certain samples, the computer program causing a computer to execute:

a first storing of an upper limit of a number of bits of encoded data of a high-frequency component in the input signal finally generated in the high-pass encoding process where a plurality of parameters indicating characteristics of the high-frequency component in the input signal are calculated;

controlling the high-pass encoding process so that the number of bits of the encoded data of the high-frequency component finally generated in the high-pass encoding process becomes equal to or less than the upper limit stored at the first storing; and estimating the upper limit from a number of bits obtained by calculating a parameter from the plurality of parameters in the high-pass encoding process of an encoding target, and a second storing of the upper limit, wherein the controlling includes controlling the high-pass encoding process so that the number of bits of the encoded data becomes equal to or less than the upper limit when the upper limit is stored at the second storing.

17. An encoding method that performs a high-pass encoding process for an input signal divided into frames formed of certain samples, comprising:

a first storing of an upper limit of a number of bits of encoded data of a high-frequency component in the input signal finally generated in the high-pass encoding process where a plurality of parameters indicating characteristics of the high-frequency component in the input signal are calculated;

controlling the high-pass encoding process so that the number of bits of the encoded data of the high-frequency component finally generated in the high-pass encoding process becomes equal to or less than the upper limit stored at the first storing; and estimating the upper limit from a number of bits obtained by calculating all of the plurality of parameters in the high-pass encoding process of an encoding target, and a second storing of the upper limit, wherein the controlling includes controlling the high-pass encoding process so that the number of bits of the encoded data becomes equal to or less than the upper limit when the upper limit is stored at the second storing.

18. A non-transitory computer-readable recording medium that stores therein a computer program performing a high-pass encoding process for an input signal divided into frames formed of certain samples, the computer program causing a computer to execute:

a first storing of an upper limit of a number of bits of encoded data of a high-frequency component in the input signal finally generated in the high-pass encoding process where a plurality of parameters indicating characteristics of the high-frequency component in the input signal are calculated;

controlling the high-pass encoding process so that the number of bits of the encoded data of the high-frequency component finally generated in the high-pass encoding process becomes equal to or less than the upper limit stored at the first storing; and estimating the upper limit from a number of bits obtained by calculating all of the plurality of parameters in the high-pass encoding process of an encoding target, and a second storing of the upper limit, wherein the controlling includes controlling the high-pass encoding process so that the number of bits of the encoded data becomes equal to or less than the upper limit when the upper limit is stored at the second storing.

* * * * *